United States Patent [19]

Johnson

[11] 4,369,623

[45] Jan. 25, 1983

[54] POSITIVE DISPLACEMENT ENGINE WITH SEPARATE COMBUSTION CHAMBER

[76] Inventor: David E. Johnson, 173 West Ave., Canandaigua, N.Y. 14424

[21] Appl. No.: 188,573

[22] Filed: Sep. 18, 1980

Related U.S. Application Data

[63] Continuation of Ser. No. 863,858, Dec. 20, 1977, abandoned, and a continuation of Ser. No. 710,092, Jul. 30, 1976, abandoned, which is a continuation of Ser. No. 558,371, Mar. 14, 1975, abandoned.

[51] Int. Cl.[3] ..... F02G 1/02

[52] U.S. Cl. ..... 60/39.6; 417/349

[58] Field of Search ..... 60/39.33, 39.63, 39.64, 60/39.6; 123/64; 417/349

[56] References Cited

U.S. PATENT DOCUMENTS

| | | | |
|---|---|---|---|
| 1,831,976 | 11/1931 | Stow | 417/349 |
| 1,847,260 | 3/1932 | Pardee | 60/39.63 |
| 1,849,347 | 3/1932 | Dale | 60/39.6 |
| 1,884,077 | 10/1932 | Michlun | 417/349 |
| 3,896,775 | 7/1975 | Melby | 123/64 |

*Primary Examiner*—Robert E. Garrett

*Attorney, Agent, or Firm*—Browdy and Neimark

[57] ABSTRACT

An engine with positive displacement piston chambers, an external combustion chamber from which combustion gases pass through suitable valving to piston chambers, an air compressor, a heat exchanger where exhaust gases from the piston chambers preheat compressed air which then flows to the combustion chamber, and an accumulator for storing unneeded compressed air from the compressor. The system has the capability of regenerative braking, i.e., slowing the engine by employing it as a compressor to compress air which is passed to the accumulator.

11 Claims, 3 Drawing Figures

POSITIVE DISPLACEMENT ENGINE WITH SEPARATE COMBUSTION CHAMBER

CROSS REFERENCE TO RELATED APPLICATIONS

This is a continuation of application Ser. No. 863,858 filed Dec. 20, 1977 and it is a continuation of Ser. No. 710,092 filed July 30, 1976, which in turn is a continuation of Ser. No. 558,371 filed Mar. 14, 1975, all abandoned.

BACKGROUND OF THE INVENTION

The present invention relates to positive displacement engines and, more particularly, to a novel engine in which the combustion chamber is separated from piston chambers which receive hot gases from the combustion chamber.

The engine of the invention is thermodynamically similar to the Brayton or Joule cycle, while physically resembling the Otto cycle engine in that it utilizes one or more pistons or other positive displacement devices for compression and power. Combustion is external of the positive displacement chambers, thereby providing many advantages. The use of a combustion chamber separated from the positive displacement chambers provides greater flexibility in the form of fuel employed. Thus, solid, liquid or gaseous fuel may be utilized. The combustion temperature may be lower and the combustion time longer, resulting in more complete combustion, to thereby substantially reduce the level of pollutants in the exhaust. In addition, no critical ignition timing is necessary in such an arrangement. One or more pistons, or a portion of the operating cycle of the pistons, is utilized to compress air which is passed through a heat exchanger to be preheated while cooling exhaust gases and which is then introduced into the combustion chamber. Excess compressed air may be stored in an accumulator for subsequent use when necessary, for example, during periods of peak power demand or when the engine is cold.

During braking, regenerative braking may be achieved whereby the engine is slowed while compressing air in the compressor which is passed to an accumulator for storage and subsequent use when needed. The compressor may be disconnected on start-up so that there is very low starting torque. The stored compressed air is also available for powering auxiliary equipment as well as meeting peak power demands and upon engine start-up. The availability of compressed air for start-up provides easy cold weather starting and if desired enables the fuel to be cut off completely on idle since the engine can be restarted immediately on demand in view of the availability of compressed air which can be passed through the system to the positive displacement chambers.

The engines of the invention may in appropriate sizes be employed in a wide variety of applications. For example, when employed to power an automobile, the engine of the invention would have increased efficiency, reduced exhaust levels, fast starting capability, compressed air availability, dynamic braking, and instant power availability. For buses and trucks, the savings of braking energy would be a particularly significant factor. The engines would also find application in locomotives, stationary power plants, farm tractors, marine engines, airplanes, etc. A primary advantage of use in an airplane would be high horsepower availability for the size of the engine during take-off because of the availability of the compressed air for maximum torque as a take-off assistant.

The above and other objects, features and advantages of the invention will become more apparent as this description proceeds.

DETAILED DESCRIPTION OF THE INVENTION

Figure 1:
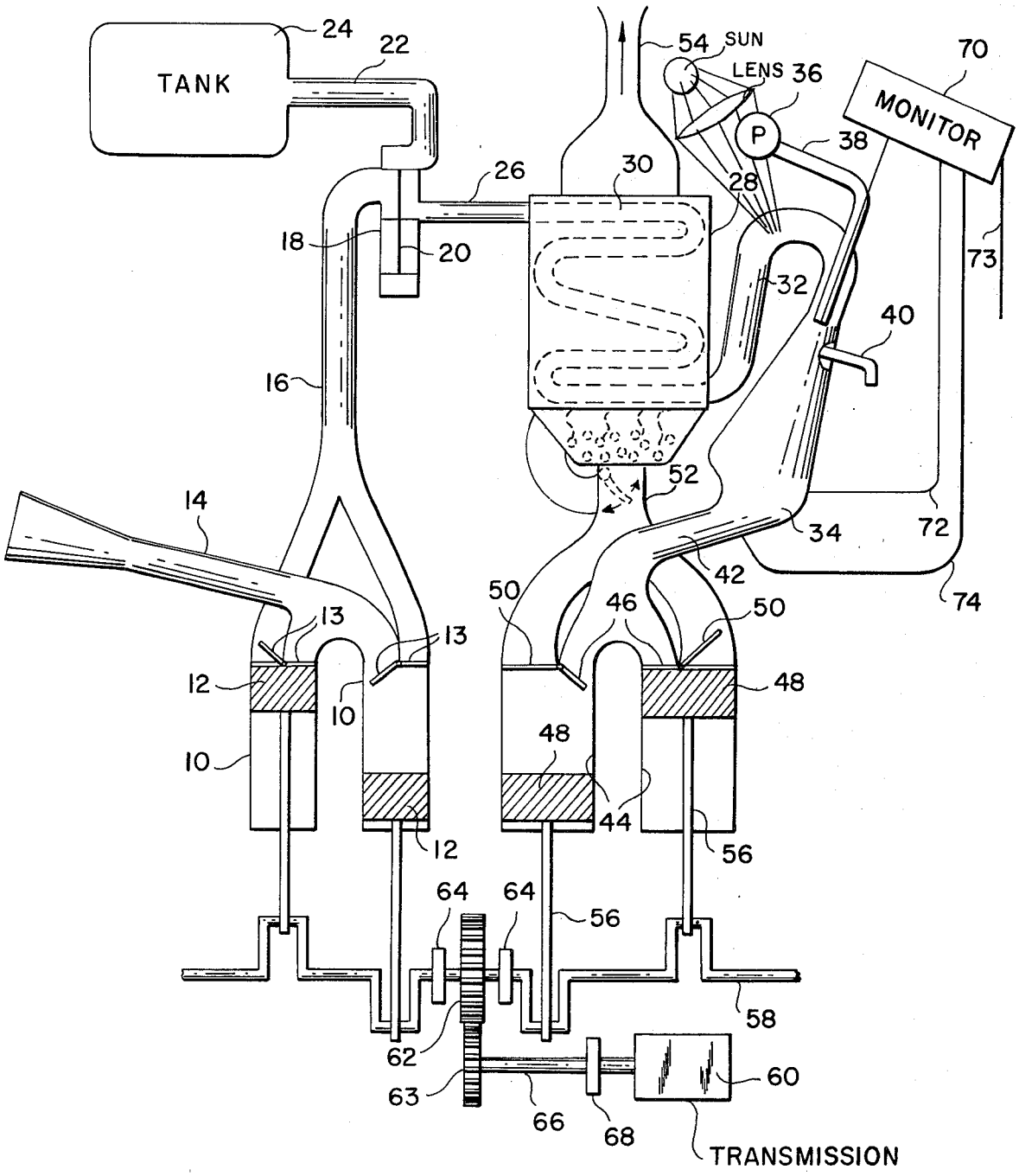
FIG. 1 is a diagrammatic view of a presently preferred embodiment of the invention in which different pistons form the air compressor and the power unit.

Referring now to FIG. 1, where one presently preferred embodiment of the invention is illustrated, the system of the invention includes an air compressor comprising a pair of cylinders 10 in which there are pistons 12. Air is drawn into the cylinders from an air inlet duct 14 into a cylinder in which the piston is in the retracted position which in the illustrated embodiment is the right hand cylinder 10. On the upstroke, air is compressed and forced into air supply duct 16. Suitable reed or poppet valves 13 are provided both at the intake and exhaust openings from cylinders 10 to permit the entrance of fresh air and the discharge of compressed air at the appropriate times in the cycle of movement of pistons 12. The compressed air is then passed through a valve 18 which has a sliding spool member 20 which permits the compressed air to be passed (a) through duct 22 into an accumulator tank 24 where compressed air may be stored, (b) into a duct 26 which leads to an air preheater 28, and (c) permits a portion of the air to flow to accumulator 24 and the remainder to the air preheater.

In the preheater 28 the air is heated by indirect heat exchange with exhaust gases via heat exchange coil 30. Heated air leaves the preheater through line 32 into the upper end of an external combustion chamber 34. In the illustrated embodiment, a fuel pump 36 pumps a liquid or gaseous fuel through fuel inlet line 38 into the combustion chamber where the fuel is ignited by a conventional igniter 40. The resulting hot combustion gases, which may be at a temperature in the order of 2,000° F. and are now at elevated pressure, pass out duct 42 at the lower end of the combustion chamber through cam operated valves 46. The power intake valves are designed to be opened approximately 40° to 50° of rotation of the crank (for each power cylinder) to allow the high pressure gases into piston chamber 44 and force one of the pistons 48 downwardly on the power stroke. When the piston reaches the bottom of its stroke, a cam operated exhaust valve 50 opens to allow the spent gas to exit via passageway 52, the air preheater 28 and an exhaust duct 54.

By a relatively simple modification, solid fuel might be burned in the combustion chamber. The combustion could be external of the power fluid circuit. For example, a solid fuel might be burned externally of the power fluid circuit or the power fluid could be heated and expanded by radiant heat.

Pistons 48 are mounted on piston rods 56 which are connected to a crankshaft 58. The crankshaft is connected to the vehicle transmission schematically indicated by reference numeral 60 via a suitable gearing system including gears 62, 63, pneumatic clutches 64 on crankshaft 58, shaft 66 connecting gear 63 and the transmission 60, and a manual clutch or a fluid coupling 68 adjacent the transmission. Pistons 12 of the air compressor are also connected to the crankshaft 58. By disengagement of the appropriate one of the clutches 64, it is possible to inactivate the power cylinders 44, for example, during braking or alternatively, to deactivate the air compressor, for example, at times of peak power output such as when accelerating or starting.

Operation of the engine is regulated by suitable control means which are diagramatically illustrated as including a control monitor 70 which receives input signals such as a signal of the pressure in the combustion chamber via line 72 and an indication of the temperature of the gases going to the power cylinders from the combustion chamber via temperature sensor line 74. In addition, monitor 70 receives an input 73 from the action of the driver, for example, when depressing the accelerator pedal or brake pedal. Monitor 70 is connected to the fuel pump to appropriately adjust the flow of fuel to the combustion chamber. The monitor also controls the pneumatic clutches 64 and pilot valve 18.

In operation, there are three primary operating modes: (1) steady state mode, (2) a regenerative braking mode, and (3) a peak power mode. In the steady state mode, which the description has been primarily directed to up to this point, air is drawn into the compressor 10 and compressed air is forced by pistons 12 through duct 16, valve 18, and air preheater 28 into combustion chamber 34. In combustion chamber 34, fuel is ignited and the resulting hot combustion gases develop the operating pressure of the engine. The high pressure gases now pass into power cylinders 44 and give up energy which is transmitted via crankshaft 58 and the associated structure to the vehicle transmission 60 to drive the vehicle. After the power stroke, the spent combustion gases now pass through the air preheater 28 where additional energy in the form of heat is reclaimed in preheating the air going to the combustion chamber.

In the regenerative braking mode, each revolution of the engine driven by inertia, for example, of the fly wheel, delivers one volume of compressed air from compressor 10 through valve 18 whose spool member 20 is now in a position blocking flow of air into duct 26 and permitting the air to flow only through duct 22 into the accumulator 24. At this time, the right side clutch 64 is disengaged due to a lowering of pressure in the combustion chamber whereby the power cylinders are mechanically and pneumatically disconnected from the compressor. The compressed air which is being stored in the accumulator 24 is then available for future use.

As the vehicle comes to a stop, if desired, the pneumatic clutch may be re-engaged rather than stall the engine and valve 18 shifted back to steady state position with low fuel input in an amount sufficient to keep the engine turning over. When the operator starts the car up from a stop, depression of the accelerator pedal will further shift valve 18 to permit the flow of a greater amount of compressed air to the combustion chamber. In the event that the operator desires peak power mode operation, for example, when quickly starting after a stop or in passing another vehicle, the left side clutch 64 may be disengaged thereby disengaging the compressor 10 from the power cylinders. The absense of the compressor torque drain during this mode provides a large power output even for a small bore engine for short duration. This time the valve 18 shifts to a middle position which permits free passage of stored air in accumulator 24 through air preheater 28 and into combustion chamber 34.

Figure 2:
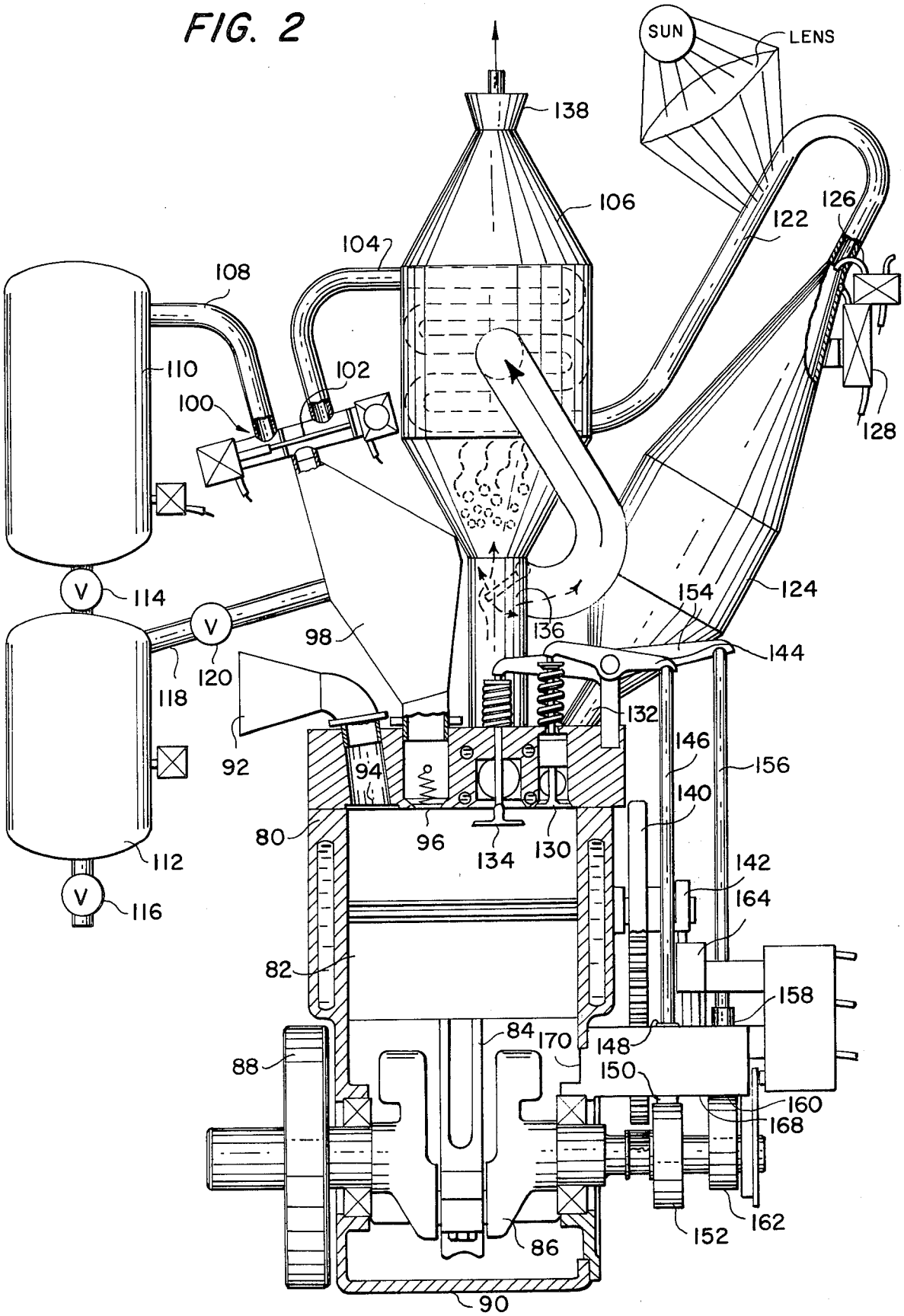
FIG. 2 is a diagrammatic view of another embodiment of the present invention in which the same pistons compress the air and function as a compressor during one stroke of the cycle and during the other strokes are driven by the hot gases from the combustion chamber.
Figure 3:
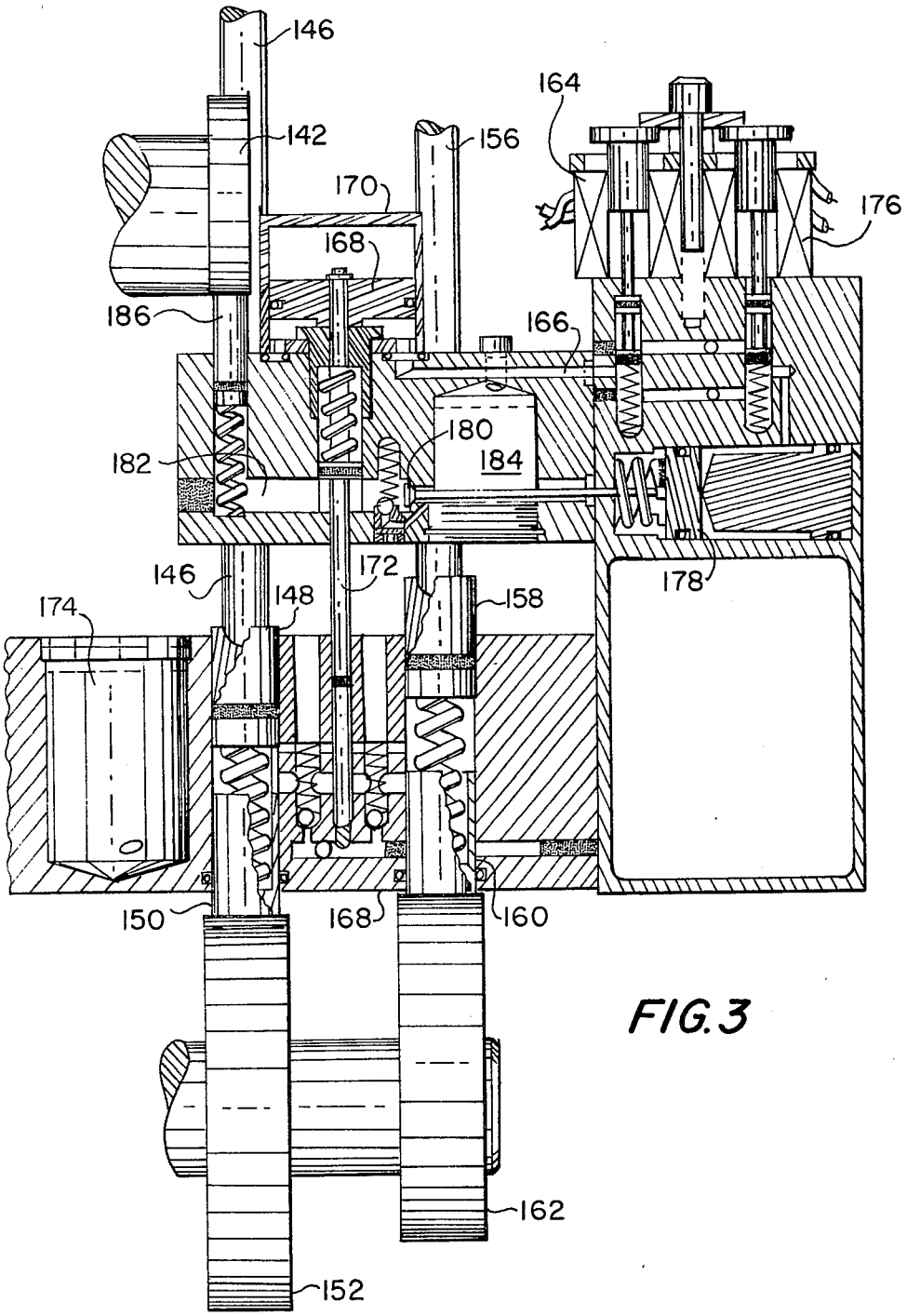
FIG. 3 is a view on an enlarged scale of part of the apparatus of FIG. 2 showing control means in greater detail.

FIG. 2 illustrates another embodiment of the invention in which air compression takes place in the positive displacement chambers during one stroke of the pistons and the remaining strokes of the cycle are power strokes in which high pressure combustion gases drive the pistons. To simplify the illustration, a single piston cylinder 80 is disclosed and it will be understood that for most applications, such as in vehicles, a plurality of such cylinders will be employed as is customary. A piston 82 reciprocates within cylinder 80 and has a piston rod 84 which is connected to a crankshaft 86 which has a fly wheel 88 at one end. A housing 90 encloses the crankshaft and the bottom of the housing may function as an oil sump.

During the air compression stage, fresh air enters the cylinder through intake 92 and a suitable valve such as a reed valve 94 due to the descending piston lowering the cylinder pressure and opening valve 94. On its return stroke, piston 82 compresses the air, closes inlet valve 94 and forces the compressed air out through a spring biased discharge valve 96 to a surge tank 98 and then into a three-way valve 100 which has a sliding spool 102. Valve 100 is comparable to the valve 18 of the FIG. 1 embodiment and performs in the same fashion. With spool member 102 in the middle position, air passes through valve 100 into line 104 to the air preheater 106 for indirect heat exchange with spent gases going to exhaust. When the spool member 102 is moved to its extreme left position, the air passes solely through line 108 to an accumulator 110. This would be the position of the valve during regenerative braking. In this embodiment there is an additional accumulator or air reserve tank 112 in communication with accumulator 110 through a one-way check valve 114. When the pressure in accumulator 110 reaches a given level, valve 114 opens and the pressurized air flows into reserve tank 112 which has a relief valve 116 for safety purposes. Air from reserve tank 112 may be passed through line 118 and a valve 120 into the surge tank 98 when needed. In this fashion, the system would always have sufficient air to start the engine when it is cold.

When valve 110 is in a middle position, the flow of air from the surge tank is divided into two streams, part of the air flowing to accumulator 110 and the remainder to the air preheater 106.

The preheated air from air preheater 106 passes through conduit 122 into the upper end of a combustion chamber 124 which is comparable to the combustion chamber 34 of the FIG. 1 embodiment. The air enters the combustion chamber concentrically around a fuel nozzle 126 which discharges fuel into the combustion chamber for ignition by an igniter 128. The high temperature and pressure combustion gases enter the cylinder 80 upon the opening of a power intake valve 130 which receives the combustion gases from discharge conduit 132 of the combustion chamber. The high pressure gases push piston 82 downwardly rotating the crankshaft and propelling the vehicle. When crankshaft 86 has rotated about 40°-50° from top dead center (as in FIG. 1), valve 130 closes and at bottom dead center exhaust valve 134 is opened so that the spent gases are discharged through line 136 through the air preheater to exhaust duct 138.

A timing belt 140 or other suitable control mechanism is used to turn an actuating cam 142 at a 5:1 or other selected engine compression-power ratio. This cam and related valves 100, 130, and 134 operating via suitable control means, will place the engine into normal operation, regenerative braking or peak power mode.

The opening and closing of power inlet valve 130 is regulated by a two-armed lever 144, a rod 146 which has its lower end disposed in a recess in valve lifter 148 connected to a cam follower 150 associated with a cam 152 on crankshaft 86. When cam 152 is in position as shown, rod 146 is depressed and via the two-armed lever 144, valve 130 is closed. When a high point on the cam 152 is in contact with cam follower 150, rod 146 is elevated causing the valve 130 to open.

Actuation of the discharge valve 134 is accomplished in a similar fashion via a two-armed lever 154, rod 156, valve lifter 158, cam follower 160, and cam 162 on the crankshaft.

During a regenerative braking cycle of operation, in addition to the flow of fuel being interrupted, valves 130 and 134 are inactivated. This inactivation is accomplished via a solenoid valve 164 when in the down position permits high pressure air to pass through line 166 from a suitable source, for example, the accumulator and elevate piston 168 in an air cylinder 170. Elevation of the piston 168 and of a control rod 172 attached hereto cancels the action of cams 152 and 162 by inactivating the hydraulic system associated with the cams since elevation of rod 172 opens a return passage to oil reservoir 174. Thus elevation of cam followers 150 and 160 by cams 152 and 162 is not effective to elevate the valve lifters for rod 146 leading to inlet valve 130 or for rod 156 leading to exhaust valve 134.

At the same time, by a suitable control mechanism, which might include the air cylinder 170, spool member 102 of valve 100 is shifted to the extreme right position so that the surge tank 98 communicates only with accumulator 110. Now on the down stroke of the piston, air is sucked through intake 92 and valve 94, compressed as the piston moves up, and the compressed air is forced through valve 96 and surge tank 98 into accumulator 110 and, if necessary, into reserve tank 112.

At the conclusion of the braking mode, when the engine is restarted, the stored compressed air leaves accumulator 110 through valve 100 which has now moved to a position permitting this flow, and eventually into cylinder 80 through power inlet valve 130. Thus, the engine may be restarted although it was not idling. If the engine had 3 cylinders or more, there would not be a dead spot in the engine and therefore this high pressure air would cause the engine to function as an air motor and start up without idling. The present engine is a very low emission engine since fuel loss during idling is substantially reduced and may be completely eliminated if the flow of fuel ceases completely during braking.

In the full power mode of operation, a solenoid valve 176 is employed to cancel the action of cam 142 so that there is no regenerative cycle. This may be accomplished in various ways, for example, depression of the solenoid valve 176 may cause flow of air against the face of an air cylinder 178 moving valve 180 to an open position so that oil in chamber 182 may return to oil reservoir 184. Since hydraulic pressure is not maintained in chamber 182, depression of cam follower 186 associated with cam 142 does not result in hydraulic pressure being applied against piston 188 associated with rod 172.

In normal operation, cam 142 rotating at one-fifth the speed of the motor is effective through depression of cam follower 186 and the hydraulic fluid acting upon piston 188 to cancel the action of the valve lifters associated with rods 146 and 156 on every fifth revolution of the cams since elevation of the rod 172 permits oil to return to reservoir 174.

While presently preferred embodiments of the invention have been shown and described with particularity, it will be appreciated that various changes and modifications can be made therein within the teachings of the invention. For example, the engine can be designed to supply excess air during normal operation, and thus can be used as an air compressor for various purposes ranging from large portable construction type units to small paint stray type units.

As another embodiment, the combustion may be external of the power fluid circuit. In such a case, a combustion chamber could be located in the bottom of the air heater in lieu of where illustrated in FIGS. 1 and 2. The power fluid would be pressurized air, and the spent power fluid would be the oxidizer for the combustion chamber. The power fluid would be heated and pressurized by indirect rather than direct heat exchange.

In similar fashion the air from the air heater could be further heated and pressurized to obtain the power fluid by radiant heat acting on the air while in line 32 of FIG. 1 or conduit 122 of FIG. 2.

Thus it will be observed that this engine can be operated either as an I.C. (internal combustion—internal to the power fluid circuit) or E.C. (external). If the engine is operated with E.C. the exhaust from the power cylinder(s) is free from the products of combustion and may be used as the oxidizer for combustion of the fuel (solid, liquid or gas—any fuel that would leave a residue or harmful ash inside the engine will be burned externally). A shutter or throttle valve would direct the hot exhaust air through or around the burning fuel as needed. For solid fuel, particle size would determine fire response time.

The ability to burn solid fuel particles (saw dust, pulverized straw and hay) makes this engine attractive as a power plant for farm tractors, etc. Radiation heating is another available option for these engines and would be directed at the conduit between the preheater and power cylinder (FIGS. 1 and 2).

I claim:

1. A low pressure, low combustion temperature engine of the Brayton or Joule type having reduced level of pollutants in its exhaust and having a steady state mode, a braking mode and a peak power mode, the engine comprising: means defining at least one power stage including a positive displacement chamber; a combustion chamber located externally of said displacement chamber to supply a power fluid to said displacement chamber; a reciprocating piston provided in said displacement chamber and driven by said power fluid during power strokes of an operating cycle; air inlet means including a first valve opening into said displacement chamber for supplying air at ambient atmospheric pressure to said displacement chamber and air outlet means including a second valve opening out of said displacement chamber for allowing compressed air to exit said displacement chamber, said air inlet means and said air outlet means operating during a portion of engine operation to provide compressed air for passage via said outlet means to said combustion chamber to form part of the power fluid during power strokes in the steady state mode, said air outlet means supplying air from said displacement chamber during about each fifth stroke of said piston during the normal steady state mode of the engine; and accumulator coupled to said displacement chamber to receive compressed air therefrom via said air outlet means and to supply stored compressed air to said combustion chamber; control means effective during a braking mode of operation to interrupt flow of power fluid from said combustion chamber to said displacement chamber via a third valve and flow of exhaust from said displacement chamber via a fourth valve and to enable said piston to compress air on each compressing stroke and pass compressed air to said accumulator; and means to selectively supply compressed air from said accumulator to said combustion chamber both on starting the engine and during the full power mode of the operating cycle while interrupting flow of air from said displacement chamber to said accumulator.

2. An engine according to claim 1, including means operative during normal steady state operation to effect supply of compressed air from said displacement chamber to said accumulator during each fifth stroke of the piston.

3. An engine according to claim 1, in combination with a second accumulator, said second accumulator being coupled to the first said accumulator via valve means.

4. An engine according to claim 1, wherein said third and fourth valves are respective spring-biased valves operated by respective rocker arms.

5. An engine according to claim 1, wherein said first, second, third and fourth valves constitute the total number of valves which open into said positive displacement chamber.

6. An engine according to claim 1 or 5, wherein said first valve is a air pressure operated valve.

7. An engine according to claim 6, wherein said second valve is a biased-closed valve opening in response to pressure within said displacement chamber against said bias.

8. An engine according to claim 7, wherein said third and fourth valves are respective positively operated valves.

9. An engine according to claim 1, wherein said second valve is a spring-biased valve.

10. An engine according to claim 9, wherein said first valve is a flap valve.

11. An engine according to claim 1, wherein said first valve is a flap valve.

* * * * *